US007184951B2

(12) United States Patent
Royle et al.

(10) Patent No.: US 7,184,951 B2
(45) Date of Patent: Feb. 27, 2007

(54) METHODS AND SYSTEMS FOR GENERATING PHASE-DERIVATIVE SOUND

(75) Inventors: John Mark Royle, Exeter (GB); James Ian King, Bath (GB); Richard David Pearson, Bristol (GB)

(73) Assignee: Radiodetection Limted, Bristol (GB)

( * ) Notice: Subject to any disclaimer, the term of this patent is extended or adjusted under 35 U.S.C. 154(b) by 725 days.

(21) Appl. No.: 10/076,086

(22) Filed: Feb. 15, 2002

(65) Prior Publication Data

US 2003/0158729 A1 Aug. 21, 2003

(51) Int. Cl.
*G10L 13/02* (2006.01)

(52) U.S. Cl. ..... 704/205; 704/268

(58) Field of Classification Search ..... None
See application file for complete search history.

(56) References Cited

U.S. PATENT DOCUMENTS

| | | | | |
|---|---|---|---|---|
| 3,697,703 | A * | 10/1972 | Clark et al. | 704/203 |
| 3,955,050 | A | 5/1976 | DiToro | 179/1 SA |
| 4,048,654 | A * | 9/1977 | Wegner | 348/485 |
| 5,581,652 | A * | 12/1996 | Abe et al. | 704/222 |
| 5,661,433 | A | 8/1997 | LaRosa et al. | 329/341 |
| 6,732,070 | B1 * | 5/2004 | Rotola-Pukkila et al. | 704/219 |
| 6,889,182 | B2 * | 5/2005 | Gustafsson | 704/205 |

OTHER PUBLICATIONS

International Preliminary Examination Report dated Oct. 8, 2003.
International Search Report dated Aug. 1, 2003.

* cited by examiner

*Primary Examiner*—Abul K. Azad
(74) *Attorney, Agent, or Firm*—Baker & Hostetler LLP

(57) ABSTRACT

Methods and systems for digitally generating sound from phase and amplitude information of a narrow bandwidth signal, such as a narrow bandwidth locator signal. Phase-derivative information is determined from the phase information. The bandwidth of the phase-derivative information is spread out, or stretched, over a wider bandwidth, so that the frequency variations will be more perceptible to users. The result is combined with an audio band carrier frequency, the result of which controls an oscillator. The oscillator output is combined with the amplitude information to generate an analog audio signal that is modulated with the amplitude information and the phase-derivative information. The amplitude information wider bandwidth phase-derivative information are used to modulate an audio carrier in both frequency and amplitude. The overall process can be thought of as a translation of the frequency and amplitude information from the narrow bandwidth around the locate frequency to a wider bandwidth on a chosen carrier frequency in the audio band. The received amplitude and phase information is received at an input sample rate. Where the input sample rate is relatively low, the amplitude and phase information are up-sampled to an output sample rate that is higher than a desired audio frequency. The higher output sample rate insures that there are sufficient samples of the signal during each cycle or period of the audio frequency. The higher sample rate is typically also the sample rate of a digital to analog converter that outputs an analog signal to a speaker. The amplitude information and/or phase derivative information are optionally scaled to system gain. The sound heard by the operator can optionally be adjusted with an optional selectivity filter.

17 Claims, 6 Drawing Sheets

METHODS AND SYSTEMS FOR GENERATING PHASE-DERIVATIVE SOUND

BACKGROUND OF THE INVENTION

The invention relates to generation of sound.

RELATED ART

Information can be imbedded in electrical signals by varying the amplitude, phase, or frequency of the signals. The variations can be used to drive a speaker to generate sound that represents the information.

In some situations, variations are relatively small. Signals with relatively small variations are referred to as narrow bandwidth signals. Absent additional processing, it is difficult for most humans to perceive tonal variations generated from narrow bandwidth signals. As a result, complex algorithms are often employed to spread the variations over a wider range. Such algorithms tend to require greater signal processing capabilities.

Lower frequency information signals have to be up-converted to audio frequencies so that the resultant sound can be perceived by humans. In digital systems, sampling rates should be much greater than the audio frequency so that there are sufficient samples for each audio cycle. At higher data rates, however, the complex algorithms discussed above require even greater processing capabilities.

What are needed are methods and systems for generating sound from narrow bandwidth signals, and having reduced digital signal processing requirements.

SUMMARY OF THE INVENTION

In accordance with the invention, sound is digitally generated from phase and amplitude information of a narrow bandwidth signal, such as a narrow bandwidth locator signal or an RF signal that includes information within a narrow band. Phase-derivative information is calculated or measured from the phase information. The phase-derivative information is spread out, or stretched, over a wider bandwidth, so that the frequency variations will be more perceptible to users. The amplitude information and the wider-bandwidth phase-derivative information, are used to modulate an audio carrier in both frequency and amplitude. The overall process can be thought of as a translation of the frequency and amplitude information from the narrow bandwidth around the locate frequency to a wider bandwidth on a chosen carrier frequency in the audio band. The sound heard by the operator can optionally be adjusted with an optional selectivity filter.

The amplitude and phase information is received at an input sample rate. The sample rate can be a relatively low sample rate (e.g., from a locator signal) or a relatively high sample rate (e.g., from an RF signal). Where the input sample rate is a relatively low sample rate, the amplitude and phase information is up-sampled to a sample rate that is higher than a desired audio frequency. The higher sample rate insures that there are sufficient samples of the signal during each cycle or period of the audio frequency. The higher sample rate is typically also the output sample rate of a digital to analog converter that outputs an analog signal to a speaker. Where the input sample rate is lower than the output sample rate, the phase-derivative information can be calculated or measured at the input sample rate or the output sample rate. The amplitude information and/or the phase information are optionally scaled to the system gain.

The invention can be implemented with an amplitude processing path and a phase processing path. The amplitude processing path receives amplitude information of a narrow bandwidth signal. Where the input sample rate is a relatively low sample rate, the amplitude information is up-sampled to the output sample rate. The output sample rate is preferably higher than a desired audio frequency. In an embodiment, the up-sampled amplitude information is filtered to remove components of the input sample rate.

The phase processing path receives phase information of the narrow bandwidth signal. The phase information has the input sample rate. Phase-derivative information is determined from the phase information. Where the input sample rate is lower than the output sample rate, the phase derivative information is up-sampled to the output sample rate. The phase derivative information is optionally delayed to match a filter delay in the amplitude path. Frequency gain is applied to the phase derivative information, preferably at the output sample rate. The frequency gain stretches the frequency variations over a wider bandwidth. The frequency stretched information is summed with an audio wave carrier, wherein the audio wave carrier has a frequency that is lower than the output sample rate. The resulting control information includes the frequency stretched, phase derivative information, at the output sample rate, imparted to the audio wave carrier. An oscillator is digitally controlled with the control information. The oscillator outputs frequency modulation information that varies with respect to the phase derivative information. The results of the amplitude processing path and the phase processing path are then combined into one or more analogue amplitude and frequency modulated audio signals.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The present invention will be described with reference to the accompanying drawings. The drawing in which an element first appears is typically indicated by the leftmost digit(s) in the corresponding reference number.

DETAILED DESCRIPTION OF THE INVENTION

Example Environment

Figure 1:
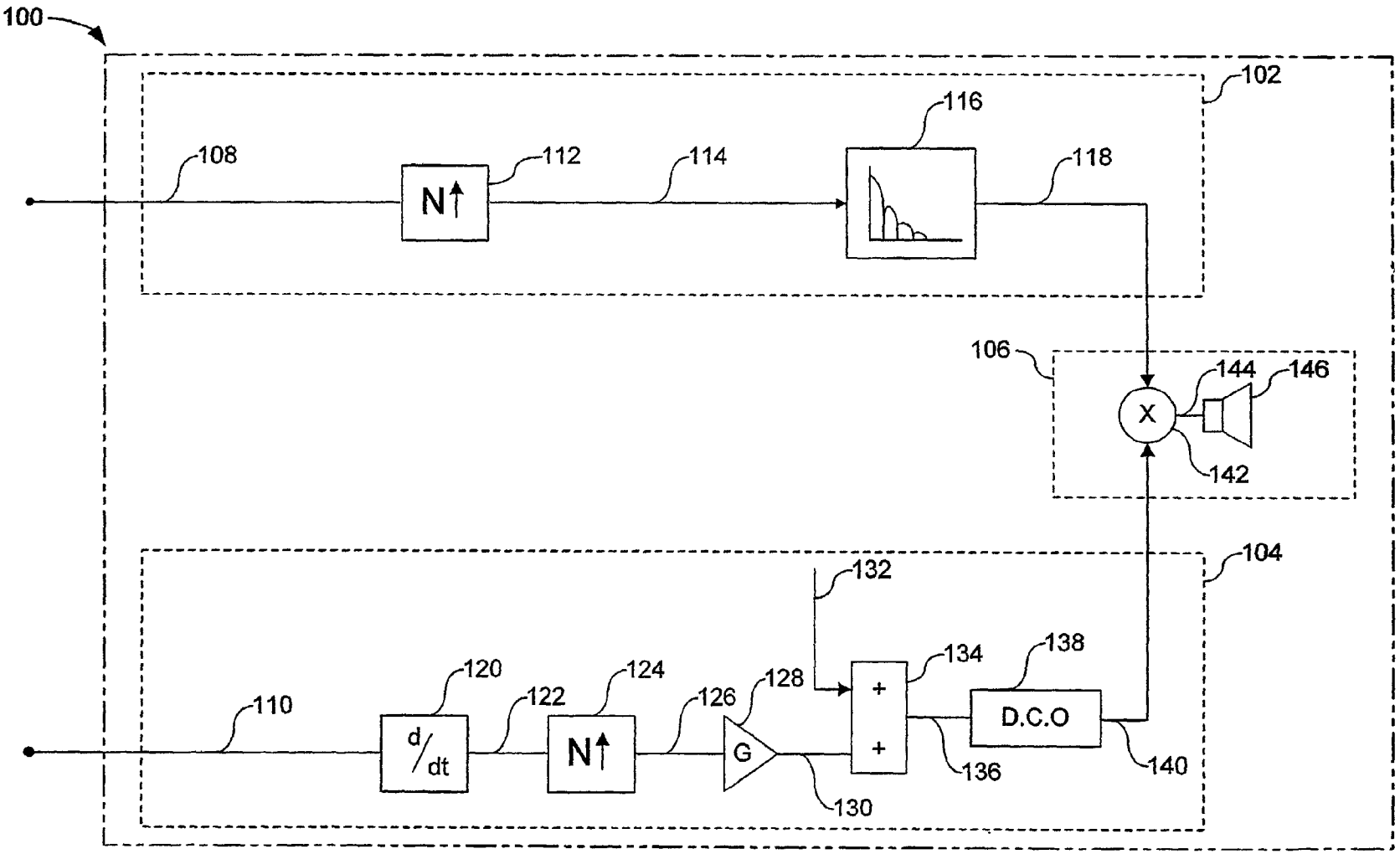
FIG. 1 is a high-level block diagram of a sound generation system for digitally generating sound from phase and amplitude information of a narrow bandwidth signal, in accordance with the invention.

The present invention is directed to digital generation of sound and, more particularly, to generation of narrow bandwidth phase-derivative sound. The present invention is described herein in relation to locators, or radio detection devices. The present invention is not, however, limited to use within radio detection devices. Based on the description herein, one skilled in the relevant art(s) will understand that the invention can be implemented in other environments as well. Such other implementations are within the spirit and scope of the invention.

Locators, also called radio detection devices, or simply detection devices, perform a number of operations relating to the detection of underground objects. These operations include locating and tracing underground cables, pipes, wires, or other types of conduits. Characteristics of underground objects, such as the depth of the object, the magnitude and direction of an electric current passing through the object, and path of the object, can also be determined by locators. Thus, the routine operations and functioning of underground objects can be monitored and defects in these objects can be easily detected.

Locators use radio frequency radiation to detect underground objects and their characteristics. A locator often includes a transmitter and receiver. In an active mode, the transmitter emits a signal at one or more active radio frequencies. The transmitter can be positioned in different ways to generate a signal that can be used to detect an object. For example, a transmitter can apply a signal to an object through induction, direct connection, or signal clamping. The receiver detects the transmitted signal and processes the detected signal to obtain desired information. In a passive operating mode, the receiver can detect passive radio frequency signals emitted by the underground object. A receiver can also detect a SONDE. A SONDE is self-contained transmitter provided on certain types of underground objects, such as non-metallic objects. Examples of commercially-available radio detection devices are locators and tools available from Radio Detection, Ltd., a United Kingdom company. Locators and tools from Radio Detection, Ltd. include devices such as the PXL-2, PDL-2, HCTx-2, LMS-2, LMS-3, PDL-4, PTX-3, and C.A.T. products.

Locators typically include a user interface to provide detection-related information to a user. A user interface can include, for example, one or more visual displays for displaying signal strength and/or directional indications. A user interface can also include a sound generation device. A sound generation device can be used to convey information to a user regarding detection strength and/or changes in detection strength due to, for example, sweeping motions of the detector over a cable.

In an embodiment, a locator operates in a narrow-band mode, wherein amplitude and/or phase information vary within a narrow relatively range. For example, in an embodiment, a low frequency locate carrier signal, such as an 8 Hz carrier signal, is modulated with amplitude and phase information corresponding to detection signals. In such an embodiment, the carrier signal frequency can vary within the relatively narrow bandwidth of zero to 8 Hz (i.e., an 8 Hz bandwidth). In order to generate sound that is perceptible to humans, the locate carrier signal, e.g. 8 Hz, has to be up-converted to an audio frequency, such as 680 Hz. Where, as here, the locate carrier signal has a narrow bandwidth, the audio band signal varies within a relatively narrow bandwidth. Absent additional processing, it would be difficult for most humans to perceive tonal variations generated from the narrow bandwidth audio band signal. As a result, complex algorithms are often employed to spread the variations over a wider range. Such algorithms tend to require greater processing capabilities. In a digital system, where the data has a relatively high sample rate, even greater processing capabilities are required.

Accordingly, the present invention is directed to methods and systems for digitally generating sound from narrow bandwidth signals, which require less intensive processing capabilities than conventional algorithms.

Overview of the Invention

In accordance with the invention, sound is digitally generated from phase and amplitude information of a narrow bandwidth signal, such as a narrow bandwidth locator signal. When necessary, the amplitude and phase information is up-sampled to a sample rate that is much higher than a desired audio frequency. The higher sample rate insures that there are sufficient samples of the signal during each cycle or period of the audio frequency. The higher sample rate is typically also the sample rate of a digital to analog converter that outputs an analog signal to a speaker. The up-sampled amplitude information is scaled to the system gain. The up-sampled frequency information is spread out, or stretched, over a wider bandwidth using a novel process, so that the frequency variations will be more perceptible to humans. The up-sampled amplitude information, and the up-sampled, wider-band frequency information, are used to modulate an audio carrier in both frequency and amplitude. The overall process can be thought of as a translation of the frequency and amplitude information from the narrow bandwidth around the locate frequency to a wider bandwidth on a chosen carrier frequency in the audio band. The sound heard by the operator can optionally be adjusted with an optional selectivity filter.

Example System Embodiments

FIG. 1 is a high-level block diagram of a sound generation system 100, in accordance with the invention. The sound generation system 100 can be implemented in hardware, software, and/or combinations thereof.

The sound generation system 100 includes an amplitude path 102, a frequency path 104, and an output section 106. The amplitude path 102 receives amplitude information 108. The frequency path 104 receives phase information 110. The amplitude information 108 and the phase information 110 represent amplitude and phase information from a narrow bandwidth signal. In a locator environment, for example, the amplitude information 108 and the phase information 110 represent information from a locator carrier signal. The amplitude information 108 and the phase information 110 are typically digital information signals having a first sample rate. In the example of FIG. 1, the amplitude information 108 and the phase information 110 have a relatively low sample rate of 200 Hz. Other sample rates can be used.

Where, as here, the amplitude information 108 and the phase information 110 have a relatively low sample rate, the information needs to be up-sampled to a higher sample rate.

One reason to up-sample to a higher sample rate is that, after performing the digital signal processes described below, the resultant digital signals are converted to analog signals for output to a speaker device. Typical analog-to-digital converter devices, such as coder-decoders (CODECs), operate at higher sample rates. Signals to be converted should have a sample rate that is similar to the sample rate of the converter.

Another reason to up-sample is that the output analog signal(s) need to be in an audio band so that a user can perceive the sound. For suitable quality sound production, the signal being converted should have a sample rate that is much higher than an audio frequency.

Accordingly, the amplitude path 102 includes a first up-sampler 112 and the frequency path 104 includes a second up-sampler 124. The second up-sampler 124 is discussed below. The up-sampler 112 up-samples the amplitude signal 108 and outputs up-sampled amplitude information 114 having a second data rate, illustrated here as 48.8 KHz. The second data rate is preferably much higher than an audio frequency. This insures that there are sufficient samples of the information during each period of the audio output. The up-sampler 112 can be implemented as a sample and hold module. In an embodiment, the up-sampler 112 uses a sample and hold filter to interpolate.

The up-sampled amplitude information 114 will typically have components of the lower sample rate. An interpolation filter 116, illustrated here as a two step sinc or "sinc^2" low pass filter, suppresses and/or eliminates the first sample rate (e.g., 200 Hz) component, which could otherwise dominate the sound output. The interpolation filter 116 preferably implements a moving average filter for an aperture width equal to the up-sampling ratio. This ensures that the interpolation filter 116 has substantially zero response to the first sample rate component (e.g., 200 Hz). The interpolation filter 116 outputs filtered, up-sampled, amplitude information 118, which is used to amplitude modulate the audio carrier signal in conjunction with frequency modulation from the frequency path 104, as described below.

The frequency path 104 is now described. The frequency path 104 includes a differentiator 120, that detects phase changes in the phase information 110. In other words, the differentiator 120 determines a time-derivative of the phase information 110. The differentiator 120 outputs frequency information 122, which has the relatively narrow bandwidth of the phase information 110.

The second up-sampler 124 up-samples the frequency information 122 to the second sample rate, and outputs up-sampled frequency information 126. The up-sampled frequency information 126 has substantially the same relatively narrow bandwidth as the frequency information 122. This would normally produce only minor audible variations that are practically imperceptible to users. In order to stretch the frequency spectrum, a frequency gain module 128 is provided. The frequency gain module 128 essentially stretches the frequency variations within the up-sampled frequency information 126 across a larger bandwidth. This provides a greater range of output sound, which will be more perceptible to users. The frequency gain module 128 outputs up-sampled, frequency information 130, having a broader bandwidth the relatively narrow bandwidth of the up-sampled frequency information 126.

The filtered, up-sampled, amplitude information 118 and the up-sampled frequency information 130 are used to amplitude modulate and frequency modulate the audio carrier. This can be performed in any of a variety of ways. For example, in FIG. 1, an audio wave carrier 132 is added to the up-sampled frequency information 130, in a summing module 134. The summing module 134 outputs control information 136, centered around the frequency of the audio wave carrier 132, illustrated here as 680 Hz.

The control information 136 controls an audio oscillator 138, which outputs frequency modulated information 140. In other words, the phase derivative (i.e, frequency information 122) of the phase information 110 is used to control the frequency of the audio oscillator 138. The audio oscillator 138 can be implemented in a variety of ways. In an embodiment, the audio oscillator 138 is implemented as a digitally controlled oscillator, such as a digitally controlled phase-quadrature oscillator as described in co-pending U.S. patent application Ser. No. 10/076,103, titled, "Digital Phase-Quadrature Oscillator," filed Feb. 15, 2002, incorporated herein by reference in its entirety, wherein control is achieved by adjusting seed values to a phase-quadrature oscillator. The audio oscillator 138 is not, however, limited to the digitally controlled phase-quadrature oscillator disclosed therein.

The frequency modulated information 140 is provided to a CODEC 142, along with the filtered, up-sampled amplitude information 118. The filtered, up-sampled amplitude information 118 and/or the frequency modulated information 140 are optionally scaled to system gain, as described below with reference to FIG. 2. The CODEC 142 modulates the frequency modulated information 140 with the filtered, up-sampled amplitude information 118, and outputs one or more modulated analog speaker drive signals 144 to a speaker system 146. In an embodiment, the speaker drive signal 144 is modulated with both amplitude and frequency information ("amplitude/frequency modulated"). The one or more speaker drive signals 144 are essentially a translation of the frequency and amplitude information from the narrow bandwidth around the locate frequency to a wider bandwidth on a chosen carrier frequency in the audio band.

The CODEC 142 typically includes a digital-to-analog converter ("DAC") that operates at an output sample rate. Where the CODEC 142 includes a DAC, the input sample rate of the CODEC 142 should be substantially the same rate as the output sample rate of the DAC. Preferably, the input sample rate of the CODEC 142 and the output sample rate of the DAC are substantially the same as the second sample rate, illustrated here as 48.8 kHz. The one or more analog amplitude/frequency modulated audio carrier signals 144 are used to drive one or more speaker systems 146.

Figure 2:
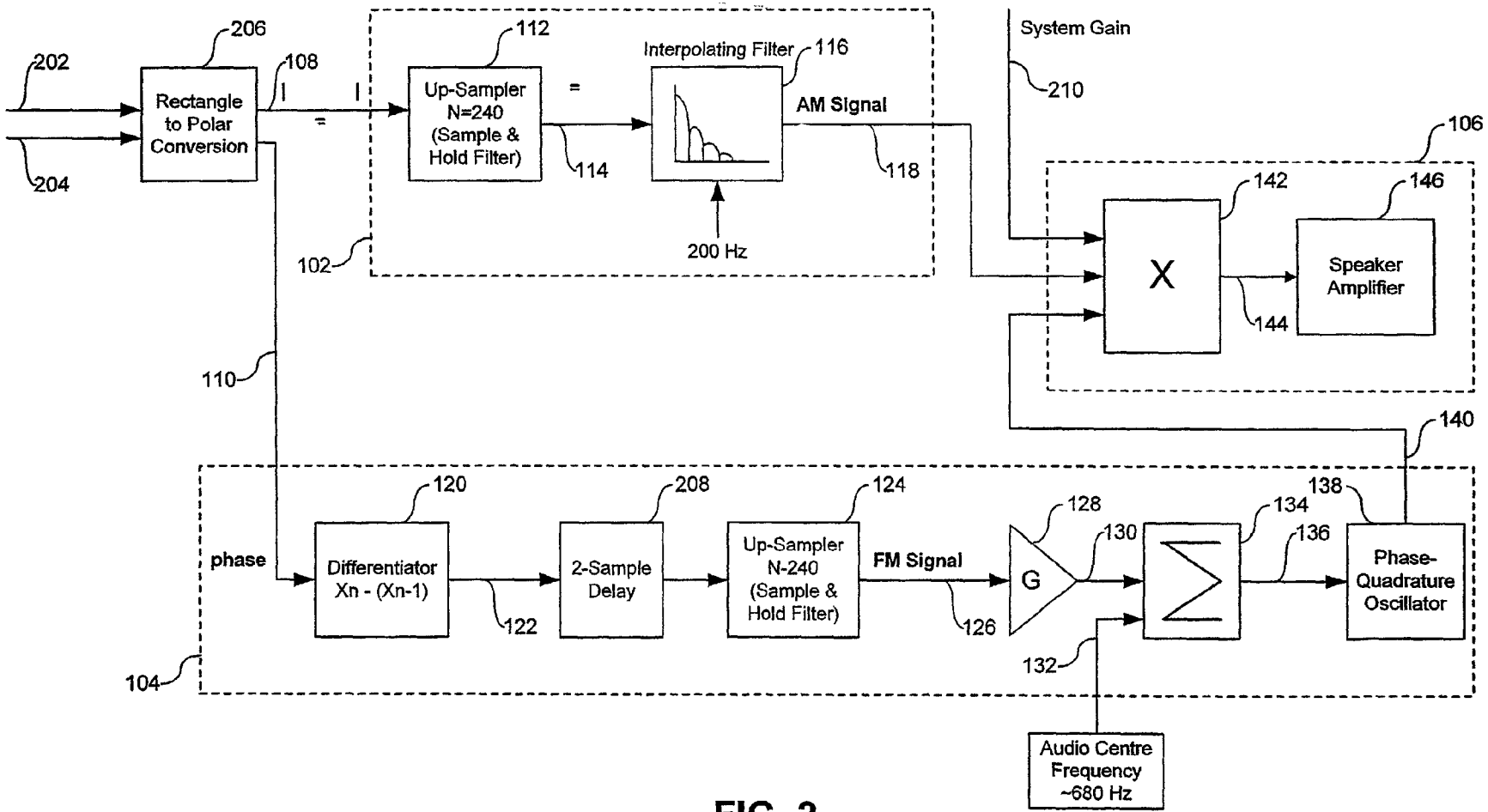
FIG. 2 illustrates the sound generation system of FIG. 1 receiving in-phase and quadrature-phase components, in accordance with an aspect of the invention.

The present invention can be implemented to process in-phase and quadrature-phase amplitude and phase signals 108 and 110. Alternatively, or additionally, the present invention can be implemented to process multiple amplitude and phase signals 108 and 110 received from multiple sources such as multiple locator antennas. For example, FIG. 2 illustrates the sound generation system 100 receiving in-phase and quadrature-phase components, 202, 204, respectively, of one or more detector signals. In this example, the in-phase and quadrature-phase components, 202, 204, are in the form of gradient equations $|1.2Bi-Ti|$ and $|1.2Bq-Tq|$, respectively, where "B" and "T" are associated with respective signal sources. For example, B and T can represent bottom and top horizontal analog antennas.

A rectangle-to-polar conversion module 206 receives the in-phase and quadrature phase components 202, 204, and outputs the amplitude information 108 as a gradient equation $|1.2B-T|$. In an embodiment, the gradient equation $|1.2B-T|$ is calculated using resolved magnitude components of the in-phase and quadrature-phase components, 202, 204. The combined results are processed through a rectangular-to-polar conversion module 206. The rectangle-to-polar conversion module 206 outputs |1.2B–T| or |V| as the phase information 110.

The amplitude path 102 uses the quantities |1.2B–T| or |V| to modulate the amplitude of the audio carrier wave 132, nominally 680 Hz, substantially as described above with respect to FIG. 1. Where the invention is implemented in a locator, and where the frequency of the audio wave carrier 132 is close to the locate carrier frequency, the frequency of the audio wave carrier 132 should be adjusted to avoid interference from the speaker drive signal(s) 144.

Recall that, where the CODEC 142 includes a DAC, the input sample rate of the CODEC 142 should be substantially the same rate as the output sample rate of the DAC. For example, where the DAC output sample rate is 48,828.125 Hz, the quantities |1.2B–T| and |V| should be up-sampled from ~200 Hz to 48,828.125 Hz.

The frequency path 104 uses a time derivative of phase from the signals '1.2B–T' or 'V', substantially as described above with respect to FIG. 1. In an embodiment, a phase angle is computed as a 16-bit unsigned integer, for which a difference calculation will produce a continuous time derivative (ie $x_n - x_{n-1}$). The phase derivative is preferably computed at the lower data rate of ~200 Hz.

An optional delay element 208 delays processing in the frequency path 104 by an amount of delay encountered in the interpolation filter 116. This helps to maintain coherence in time between the amplitude path 102 and the frequency path 104. In the example of FIG. 2, the delay element 208 is a two sample delay. Other delay periods can be used.

In FIG. 2, the CODEC 142 further receives system gain information 210. In this embodiment, the filtered, up-sampled amplitude information 118 and/or the frequency modulated information 140 are scaled to system gain.

Example Implementations

A. Example Hardware/Software/Firmware Implementations

The present invention can be implemented in hardware, software, firmware, and/or combinations thereof, including, without limitation, gate arrays, programmable arrays ("PGAs"), fast PGAs ("FPGAs"), application specific integrated circuits ("ASICs"), processors, microprocessors, microcontrollers, and/or other embedded circuits, processes and/or digital signal processors, and discrete hardware logic. The present invention is preferably implemented with digital electronics but can also be implemented with analog electronics and/or combinations of digital and analog electronics.

Figure 6:
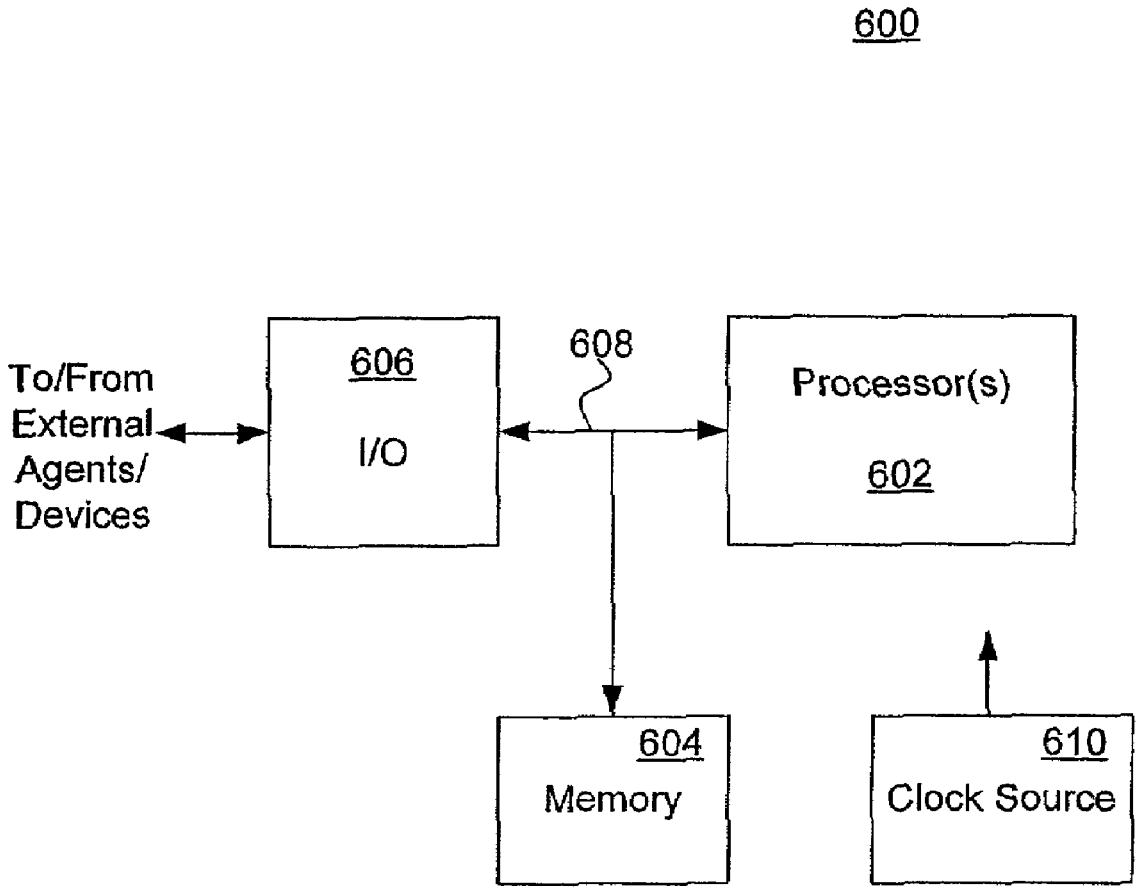
FIG. 6 illustrates an example processing system/environment in which the present invention can be implemented.

FIG. 6 illustrates an example processing system/environment 600, in which the present invention can be implemented. Processing system 600 includes a processor 602 (or multiple processors 602), a memory 604, an input/output (I/O) interface (I/F) 606, and a communication I/F 608 coupled between the processor, memory, and I/O I/F. System 600 may also include a local clock source 610. System 600 communicates with external agents/devices using I/O I/F 606. I/O I/F 606 can include interfaces for interfacing to external memory, external communication channels, external clocks and timers, external devices, and so on.

Memory 604 includes a data memory for storing information/data and a program memory for storing program instructions. Processor 602 performs processing functions in accordance with the program instructions stored in memory 604. Processor 602 can access data in memory 604 as needed. Additionally, or alternatively, processor 602 may include fixed/programmed hardware portions, such as digital logic, to perform some or all of the above-mentioned processing functions without having to access program instructions in memory 604.

The sound generation system 100 can be implemented using processing environment 600. For example, one or more of functional blocks illustrated in the drawings can be implemented in environment 600.

B. Example Computer Program Implementations

Figure 3:
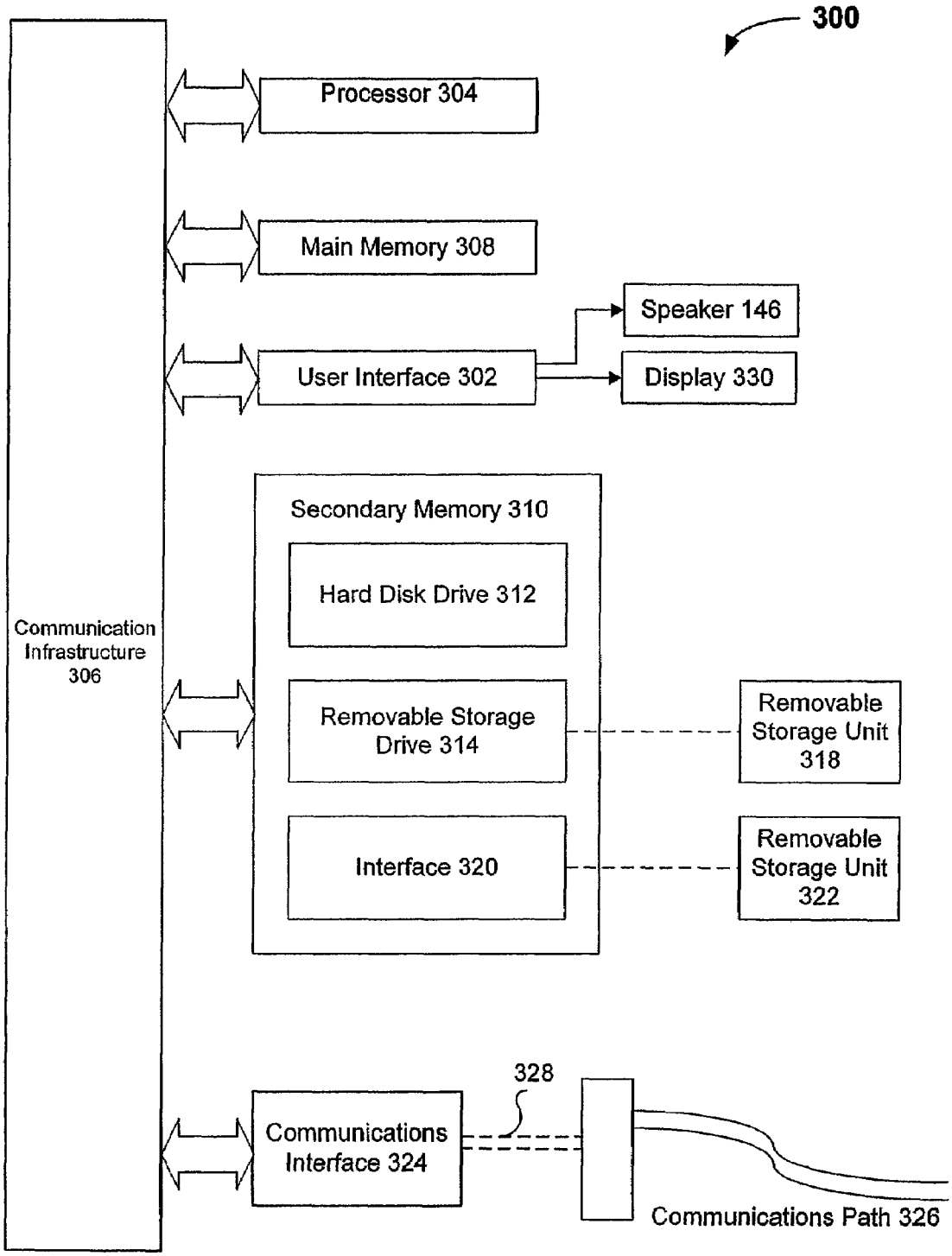
FIG. 3 illustrates an example computer system in which the present invention can be implemented.

The present invention can be implemented in computer-readable code, or software, that executes on a computer system. FIG. 3 illustrates an example computer system 300, in which the present invention can be implemented as computer-readable code. Various embodiments of the invention are described in terms of this example computer system 300. After reading this description, it will become apparent to a person skilled in the relevant art how to implement the invention using other computer systems and/or computer architectures.

The example computer system 300 includes one or more processors 304, which are connected to a communication infrastructure 306.

Computer system 300 includes a main memory 308, which, in an embodiment, includes random access memory (RAM).

In an embodiment, computer system 300 includes a secondary memory 310. Example embodiments of secondary memory 310 are described below.

In an embodiment, secondary memory 310 includes a hard disk drive 312, which includes a computer usable storage medium capable of storing computer programs and/or computer usable information.

In an embodiment, secondary memory 310 includes one or more removable storage drives 314. In an embodiment, removable storage drive(s) 314 include one or more of a floppy disk drive, a magnetic tape drive, and optical disk drive. Alternatively, or additionally, removable storage drive(s) 314 include one or more other types of removable storage drives.

Each removable storage drive 314 is typically associated with one or more removable storage units 318. In an embodiment, removable storage unit(s) 318 include one or more of a floppy disk, a magnetic tape, and an optical disk. Alternatively, or additionally, removable storage unit(s) 318 include one or more other types of removable storage units. Removable storage drive(s) 314 read from and/or write to associated removable storage unit(s) 318.

In an embodiment, secondary memory 310 includes one or more other storage devices, such as, for example, a removable storage unit 322 and an interface 320. Examples include, without limitation, a program cartridge and cartridge interface (such as that found in video game devices), PCMCIA devices, and a removable memory chip (such as an EPROM, or PROM) and associated socket.

In an embodiment, computer system 300 includes a communications interface 324, which interfaces between communications infrastructure 306 and a communications path 326. Communications path 326 couples computer system 300 to one or more external systems. In an embodiment, communications interface 324 processes and/or formats signals 328 between formats suitable for communications infrastructure 306 and formats suitable for communications path 326.

In an embodiment, communications interface 324 includes one or more of a modem, a network interface (such as an Ethernet card), a communications port, a PCMCIA slot and card, and other communications interfaces.

In an embodiment, communications path(s) 326 is implemented using one or more of wires, cables, fiber optics lines, telephone lines, cellular phone links, RF links, and other communications mediums.

In an embodiment, signals 328 are one or more of electronic, electromagnetic, and optical signals. Other types of signals can also be carried.

In an embodiment, one or more user interfaces 302 interface one or more speakers 146 and/or one or more displays 330 with the communications infrastructure 302.

In operation, the invention is imbedded in computer executable code imbedded in a computer readable medium such as one or more of the memory and/or storage devices described above. Alternatively, or additionally, the invention is imbedded in computer executable code received through the communications path 326.

EXAMPLE METHODS FOR DIGITALLY GENERATING SOUND

Figure 4:
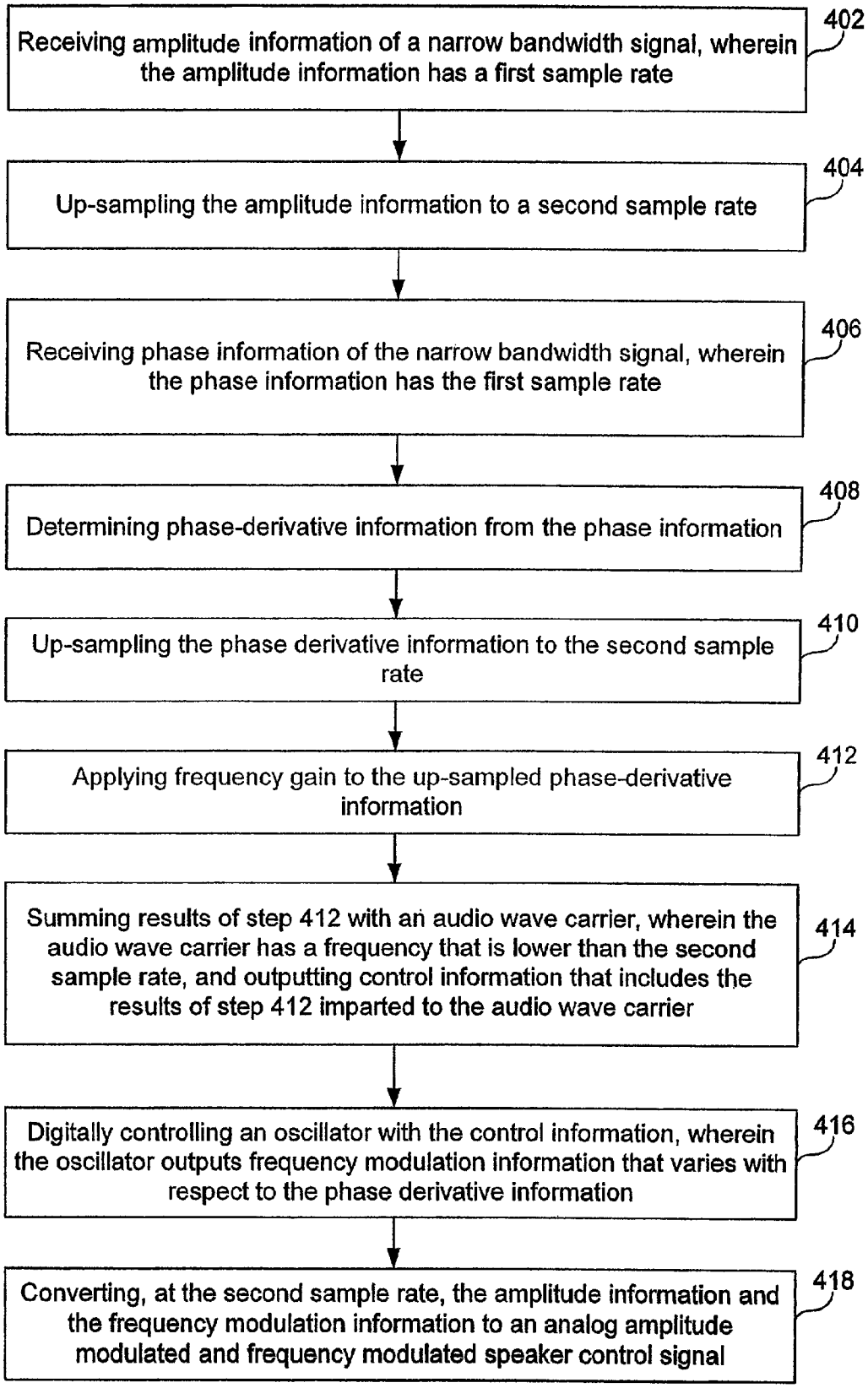
FIG. 4 illustrates an example process flowchart for digitally generating sound from phase and amplitude information of a narrow bandwidth signal, in accordance with an aspect of the invention.

FIG. 4 illustrates an example process flowchart 400 for digitally generating sound from phase and amplitude information of a narrow bandwidth signal. For illustrative purposes, the process flowchart 400 is described with reference to one or more of the previous drawing figures. The invention is not, however, limited to implementation with the previous drawing figures.

The process begins at step 402, which includes receiving amplitude information of a narrow bandwidth signal, wherein the amplitude information has a first sample rate. In the examples of FIGS. 1 and 2, this is illustrated as the amplitude information 108.

Step 404 includes up-sampling the amplitude information to a second sample rate. In the examples of FIGS. 1 and 2, this is illustrated by the first up-sampler 112, which outputs the up-sampled amplitude information 114. In an embodiment, the up-sampled amplitude information 114 is filtered to remove components of the first sample rate. In the examples of FIGS. 1 and 2, this is illustrated by the interpolation filter 116, described above.

Step 406 includes receiving phase information of the narrow bandwidth signal, wherein the phase information has the first sample rate. In the examples of FIGS. 1 and 2, this is illustrated as the phase information 110.

Step 408 includes determining phase-derivative information from the phase information. In the examples of FIGS. 1 and 2, this is illustrated by the differentiator 120, which outputs the phase derivative information as frequency information 122.

Where the up-sampled amplitude information 114 is filtered as described above, the frequency information 122 is optionally delayed by an amount of delay inherent in the filter 116, as described above.

Step 410 includes up-sampling the phase derivative information to a second sample rate. In the examples of FIGS. 1 and 2, this is illustrated by second up-sampler 124, which outputs the up-sampled frequency information 126.

Step 412 includes applying frequency gain to the up-sampled frequency information. In the examples of FIGS. 1 and 2, this is illustrated by the frequency gain module 128, which outputs the up-sampled frequency information 130.

Step 414 includes summing results of step 412 with an audio wave carrier, wherein the audio wave carrier has a frequency that is lower than the second sample rate, and outputting control information that includes the results of step 412 imparted to the audio wave carrier. In the examples of FIGS. 1 and 2, the up-sampled frequency information 130 is summed with the audio wave carrier 132 in the summing junction 134, which outputs the control information 136.

Step 416 includes digitally controlling an oscillator with the control information, wherein the oscillator outputs frequency modulation information that varies with respect to the phase derivative information. In the examples of FIGS. 1 and 2, the audio oscillator 138 is controlled by the control information 136. The audio oscillator 138 outputs the frequency modulation information 140.

Step 418 includes converting, at the second sample rate, the up-sampled amplitude information and the frequency modulation information to an analog amplitude/frequency modulated speaker control signal. In the examples of FIGS. 1 and 2, where the interpolation filter 116 is implemented, the CODEC 142 combines the filtered, up-sampled amplitude information 118 and the frequency modulation information 140, and outputs the speaker drive signal 144. Alternatively, where the interpolation filter 116 is omitted, the CODEC 142 combines the up-sampled amplitude information 114 and the frequency modulation information 140, and outputs the speaker drive signal 144. In an embodiment, the up-sampled amplitude information 118 and/or the frequency modulation information 140 are scaled with system gain, illustrated in FIG. 2 as system gain 210.

In the examples above, processing begins with a relatively low bandwidth, low sample rate signal. Alternatively, processing begins with a relatively low bandwidth, high sample rate signal. In other words, in an embodiment, the phase information 108 and the amplitude information 110 have relatively high sample rates, preferably the same sample rate as the CODEC 142. For example, the phase information 108 and the amplitude information 110 can originate from a radio frequency signal containing information in a narrow bandwidth, which has been converted to relatively high sample rate phase information 108 and amplitude information 110. In such a case, the up-samplers 112 and 124, and the interpolation filter 116 in FIGS. 1 and 2 are omitted, and the differentiator 120 operates at the higher sample rate. Similarly, in FIG. 4, steps 404 and 410 are omitted.

Figure 5:
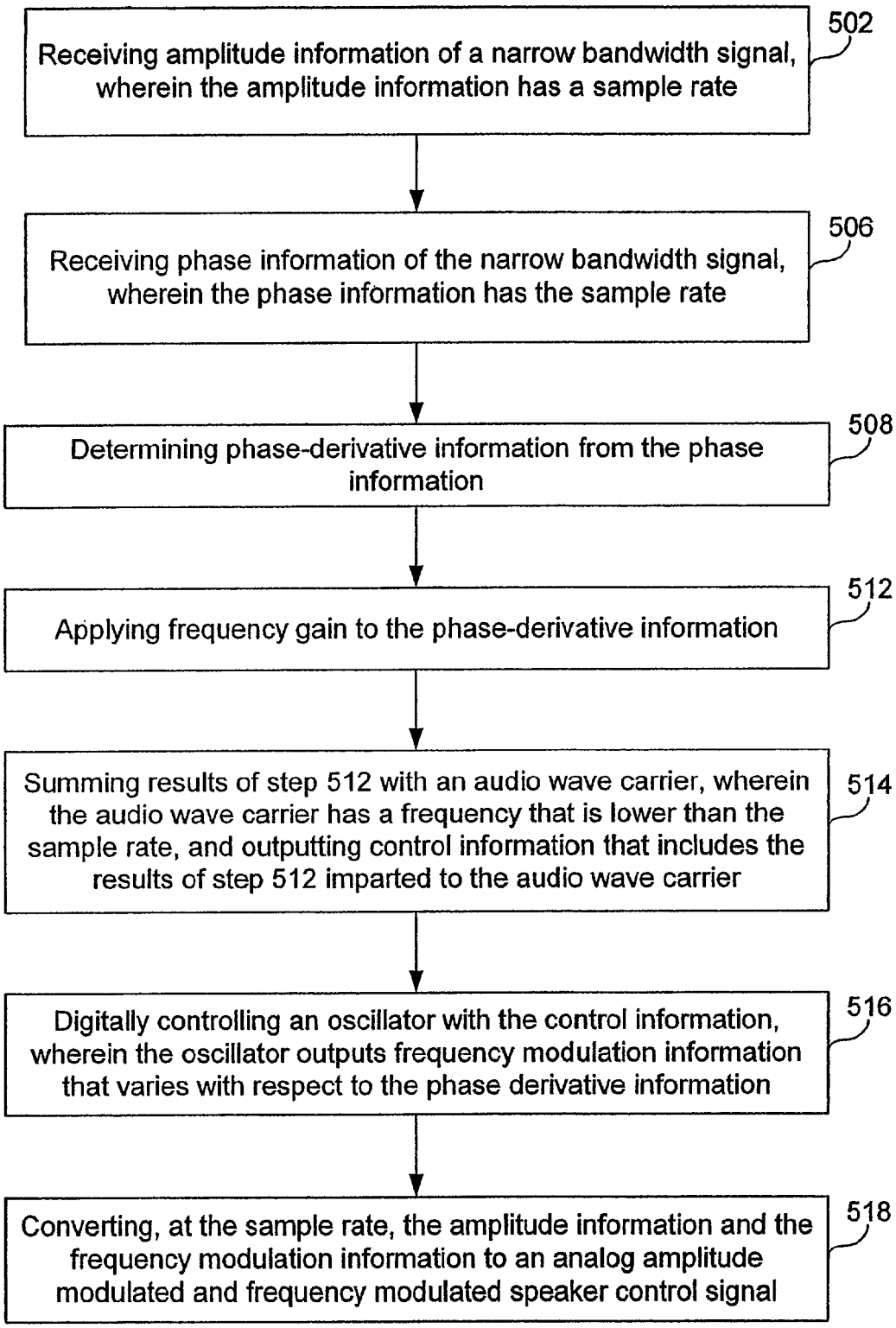
FIG. 5 illustrates another example process flowchart for digitally generating sound from phase and amplitude information of a narrow bandwidth signal, in accordance with an aspect of the invention.

FIG. 5 illustrates a illustrates an example process flowchart 500 in accordance with this aspect of the invention. The process begins at step 502, which includes receiving amplitude information of a narrow bandwidth signal, wherein the amplitude information has a sample rate. Processing proceeds to step 506, which includes receiving phase information of the narrow bandwidth signal, wherein the phase information has the sample rate. Step 508 includes determining phase-derivative information from the phase information. Processing proceeds to step 512 includes applying frequency gain to the frequency information. Step 514 includes summing results of step 412 with an audio wave carrier, wherein the audio wave carrier has a frequency that is lower than the sample rate, and outputting control information that includes the results of step 412 imparted to the audio wave carrier. Step 516 includes digitally controlling an oscillator with the control information, wherein the oscillator outputs frequency modulation information that varies with respect to the phase derivative information.

Step 418 includes converting, at the sample rate, the amplitude information and the frequency modulation information to an analog amplitude/frequency modulated speaker control signal.

CONCLUSIONS

The present invention has been described above with the aid of functional building blocks illustrating the performance of specified functions and relationships thereof. The boundaries of these functional building blocks have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognize that these functional building blocks can be implemented by discrete components, application specific integrated circuits, processors executing appropriate software and the like or any combination thereof.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A method for digitally generating sound from phase and amplitude information of a narrow bandwidth signal, comprising:

(1) receiving said amplitude information and said phase information of said narrow bandwidth signal;

(2) determining phase-derivative information from said phase information;

(3) applying frequency gain to said phase-derivative information;

(4) summing results of step (3) with an audio wave carrier having an audio band frequency, and outputting control information that includes said results of step (3) imparted to said audio wave carrier;

(5) controlling an oscillator with said control information, wherein said oscillator outputs frequency modulation information that varies with respect to said phase-derivative information; and (6) converting, at an output sample rate that is higher than said audio band frequency, said amplitude information and said frequency modulation information to an analog amplitude/frequency modulated speaker control signal.

2. The method according to claim 1, wherein said amplitude information and said phase information have an input sample rate that is lower than said audio band frequency, wherein step (3) comprises up-sampling said phase-derivative information to said output sample rate and applying said frequency gain to said up-sampled phase-derivative information, the method further comprising: (7) up-sampling said amplitude information to said output sample rate prior to step (6).

3. The method according to claim 2, wherein step (7) further comprises filtering components of said input sample rate from said up-sampled amplitude information.

4. The method according to claim 3, wherein said filtering comprises performing an interpolation operation on said up-sampled amplitude information.

5. The method according to claim 3, wherein said filtering comprises a two-step sinc low pass filter interpolation operation.

6. The method according to claim 3, wherein step (3) comprises delaying said phase-derivative information to maintain coherence with said filtering.

7. The method according to claim 2, further comprising scaling said amplitude information to system gain.

8. The method according to claim 2, further comprising scaling said phase-derivative information to system gain.

9. The method according to claim 2, wherein said input sample rate is approximately 200 Hz, said output sample rate is approximately 48.8 kHz, and said audio band frequency is approximately centered around 680 Hz.

10. The method according to claim 1, wherein said amplitude information and said phase information have an input sample rate that is substantially equal to said output sample rate.

11. The method according to claim 10, further comprising scaling said amplitude information to system gain.

12. The method according to claim 10, further comprising scaling said phase-derivative information to system gain.

13. An apparatus for digitally generating sound from phase and amplitude information of a narrow bandwidth signal, comprising:

means for receiving said amplitude information and said phase information of said narrow bandwidth signal;

means for determining phase-derivative information from said phase information; means for applying frequency gain to said phase-derivative information and for outputting broader-bandwidth phase-derivative information;

means for summing said broader-bandwidth phase-derivative information with an audio wave carrier having an audio band frequency, said means for summing including means for outputting control information that includes said broader-bandwidth phase-derivative information imparted to said audio wave carrier;

means for digitally controlling an oscillator with said control information, wherein said oscillator outputs frequency modulation information that varies with respect to said broader-bandwidth phase-derivative information; and means for converting, at an output sample rate that is higher than said audio band frequency, said amplitude information and said frequency modulation information to an analog amplitude/frequency modulated speaker control signal.

14. The apparatus according to claim 13, wherein said amplitude information and said phase information have an input sample rate that is lower than said audio band frequency, said apparatus further comprising: means for up-sampling said amplitude information to said output sample rate; and means for up-sampling said phase-derivative information to said output sample rate; wherein said means for applying frequency gain comprises means for applying said frequency gain to said up-sampled phase-derivative information.

15. The method according to claim 14, wherein said input sample rate is approximately 200 Hz, said output sample rate is approximately 48.8 kHz, and said audio band frequency is approximately centered around 680 Hz.

16. The method according to claim 13, wherein said amplitude information and said phase information have an input sample rate that is substantially equal to said output sample rate.

17. A computer program product comprising a computer useable medium having computer program logic stored therein, said computer program logic enabling a computer system to digitally convert phase and amplitude information of a narrow bandwidth signal to wider-bandwidth audio frequency information, wherein said computer program logic comprises:

a first function that enables the computer to receive said amplitude information and said phase information of said narrow bandwidth signal;

a second function that enables the computer to determine phase-derivative information from said phase information;

a third function that enables the computer to apply frequency gain to said phase-derivative information and to output broader-bandwidth phase-derivative information;

a fourth function that enables the computer to sum said broader-bandwidth phase-derivative information with an audio wave carrier having an audio band frequency, and that enables the computer to output control information that includes said broader-bandwidth phase-derivative information imparted to said audio wave carrier;

a fifth function that enables the computer to control an oscillator with said control information, wherein said oscillator outputs frequency modulation information that varies with respect to said broader-bandwidth phase-derivative information; and a sixth function that enables the computer to convert, at an output sample rate that is higher than said audio band frequency, said amplitude information and said frequency modulation information to an analog amplitude/frequency modulated speaker control signal.

* * * * *